US007293683B2

(12) United States Patent
Natterer

(10) Patent No.: US 7,293,683 B2
(45) Date of Patent: Nov. 13, 2007

(54) PACKAGING MACHINE

(75) Inventor: Johann Natterer, Legau (DE)

(73) Assignee: Multivac Sepp Haggenmuller GmbH & Co. KG

( * ) Notice: Subject to any disclaimer, the term of this patent is extended or adjusted under 35 U.S.C. 154(b) by 0 days.

(21) Appl. No.: 10/865,668

(22) Filed: Jun. 10, 2004

(65) Prior Publication Data

US 2005/0056720 A1 Mar. 17, 2005

Related U.S. Application Data

(60) Provisional application No. 60/478,162, filed on Jun. 13, 2003.

(30) Foreign Application Priority Data

Jun. 13, 2003 (DE) ..... 103 26 727

(51) Int. Cl.
*B65H 20/00* (2006.01)

(52) U.S. Cl. ..... 226/172; 226/170; 53/511; 53/51

(58) Field of Classification Search ..... 226/170, 226/172, 173, 112, 188; 53/511, 51; 242/390.8, 242/390.9

See application file for complete search history.

(56) References Cited

U.S. PATENT DOCUMENTS

| | | | | |
|---|---|---|---|---|
| 2,845,764 | A | 8/1958 | Forry | |
| 3,286,817 | A | 11/1966 | Brigham | |
| 3,466,840 | A | 9/1969 | Hansen, Jr. et al. | |
| 3,469,819 | A | 9/1969 | Puretic | |
| 3,517,479 | A | 6/1970 | Pinkham | |
| 3,673,760 | A | 7/1972 | Canamero et al. | |
| 3,775,242 | A * | 11/1973 | Orbison et al. | 162/208 |
| 3,996,726 | A | 12/1976 | Schlachter | |
| 4,398,988 | A * | 8/1983 | Mullender | 156/405.1 |
| 4,660,752 | A * | 4/1987 | Rikard et al. | 226/95 |
| 5,238,165 | A * | 8/1993 | Groblacher et al. | 226/172 |
| 2003/0205605 | A1 * | 11/2003 | Gray et al. | 226/172 |

FOREIGN PATENT DOCUMENTS

DE 2146217 3/1973

(Continued)

*Primary Examiner*—Gene O. Crawford
*Assistant Examiner*—Evan Langdon
(74) *Attorney, Agent, or Firm*—McDonnell Boehnen; Hulbert & Berghoff LLP

(57) ABSTRACT

The present invention relates to a packaging machine which has transport means in the form of two transport chains (5, 6) for lateral grasping and transporting of a length of material (7) consisting of packaging material. In particular with longer plants above approximately 10 meters in transport length the stretching property of the transport chains owing to the load has a marked effect on the precision of the transport distance. This results in fluctuations of the transport distance between the two transport chains and therefore distortions of the length of material, which, depending on the type of packaging material, can even lead to tearing of the length of material. In order to minimize these fluctuations, the first transport means (5) has a first engagement element (10) engaging in the first transport means (5) and the second transport means (6) a second engagement element (11) engaging in the second transport means (6), the first engagement element (10) being coupled to the second engagement element (11) in such a way that the two engagement elements are synchronized.

17 Claims, 5 Drawing Sheets

FOREIGN PATENT DOCUMENTS

| | | |
|---|---|---|
| EP | 0 612 044 A1 | 2/1994 |
| GB | 1 225 796 | 3/1971 |
| JP | 57-175526 | 10/1982 |
| JP | 59 142920 | 8/1984 |
| JP | 5178436 | 7/1993 |
| JP | 07-228 | 8/1994 |

* cited by examiner

PACKAGING MACHINE

This application claims priority to U.S. Provisional Application Ser. No. 60/478,162, filed Jun. 13, 2003.

FIELD OF THE INVENTION

The present invention relates to a packaging machine and particularly to a packaging machine having a transport mechanism.

BACKGROUND OF THE INVENTION

An exemplary packaging machine can be seen in DE 2 123 133, incorporated herein by reference. Such a packaging machine has a frame having two frame parts arranged parallel to one another in the longitudinal direction. At one end of the two frame parts chain wheels are provided in each case, via which run two transport chains in the form of continuous chains. The individual chain links of the transport chains are equipped with clamps which hold a length of packaging material, such as a foil, at the edges. When the chain links come into engagement with the chain wheels, the clamps open, so the length of packaging material is inserted into the clamps. When the chain links are released from the chain wheels, the clamps close and the length of packaging material is held in a tensioned state between the transport chains. The chain wheels are in each case cantilevered on an axle. Between the chain wheels a foil guide drum for the length of packaging material is supported as freely rotatable about an axle. At the other end of the two frame parts further chain wheels are provided, which serve to open the clamps again by engaging in the transport chains, so the length of packaging material is released from the clamps. Various working stations are arranged along the frame. During transport of the length of packaging material through the working stations high precision of the forward feeds of both chains is required, in order to achieve as low forward feed tolerances as possible during successive operating cycles. Higher tolerances require more packaging material and cause increased costs. The transport chains have limited stability, however, and are elastically stretched like a spring under load. In particular with longer plants of more than approximately 10 meters in transport length, this stretching property has a marked effect on the precision of the transport distance as the load increases, owing to the length, and higher driving power results in even greater stretching. The relative stretching with greater length of the plant simultaneously gives rise to higher amounts of stretching, which cause practically over-proportionately higher tolerances. Additionally, the fluctuations can come out differently on the two transport chains and therefore cause distortions of the length of packaging, which, depending on the type of packaging material, can even lead to tearing of the length of material.

SUMMARY OF THE INVENTION

FIG. 5 should be referred to as an example of the problem to be solved. There three lines a—a, b—b and c—c are shown at the inlet of the transport length. Each of the lines represents an imaginary connecting line between two chain links corresponding to one another. Line a—a therein represents the ideal state, in which the imaginary connecting line runs parallel to the shaft 14 at the outlet, i.e. no misalignment occurs on the transport path of the two transport chains 5 and 6. Lines b—b and c—c show the possible fluctuation range of the distortion of the length of material 7. Line b—b shows the case in which chain 5 is in advance of chain 6 in transport direction A, whereas line c—c shows the case in which chain 5 is running behind chain 6. In trials it has been established that with a plant length of 10 meters and a load of 3000 newtons, an elastic lengthening of the transport chain of 15 mm can occur. A misalignment of 15 mm may sometimes be sufficient for the length of packaging material to tear or for the working station not to process the length at the correct position. A plant which is longer than 10 meters cannot therefore be implemented, at least not according to conventional thinking and methods.

The present invention provides for a packaging machine with which the tolerances of the transport paths can be minimized.

In that the first engagement element is coupled to the second engagement element in such a way that both engagement elements are coordinated to one another with synchronous angles, it can also be ensured at the inlet on the entrance side that the transport paths of the two transport means are of equal length. Possible tolerances because of uneven stretching of the transport means owing to high tensile loads can thereby be compensated. Consequently, the packaging machine can be configured with a greater length than previously, without impermissibly large tolerances being obtained in the transport paths of the two transport means.

It is an advantage of the invention to provide a torsion-proof shaft, on which the two engagement elements are arranged as fixed against rotation, as this enables a simple and economical solution to the problem on which the invention is based. Additionally it is thereby possible to retrofit old plants without great constructional outlay, by subsequently mounting the two already existing engagement elements, supported rotatably on axles, as fixed against rotation on the shaft.

It is yet another advantage of the invention to provide a drive device which jointly drives the first and second engagement elements. In this way the transport device is driven at two points by two drive devices, making it possible for introduction of the load on to the transport means to take place at several points, so it is reduced per introduction point. Moreover, the advantage is achieved that it is thereby possible to use smaller drive devices.

It is still a further advantage of the invention to provide one drive device each in each case for the first and the second engagement element and drive them synchronously. It is thereby possible to use even smaller drive devices. The drive devices are advantageously controlled by a control device, so they are synchronized with one another. In this way angle-synchronous rotation of the drive shafts is implemented, i.e. so-called electronic shafts are therein implemented, wherein one shaft acts as "master" and the other as "slave", in that it is triggered as a function of the master shaft.

The invention is explained in greater detail below using several illustrative embodiments, referring to the attached figures.

DETAILED DESCRIPTION OF EMBODIMENTS OF THE INVENTION

Figure 1:
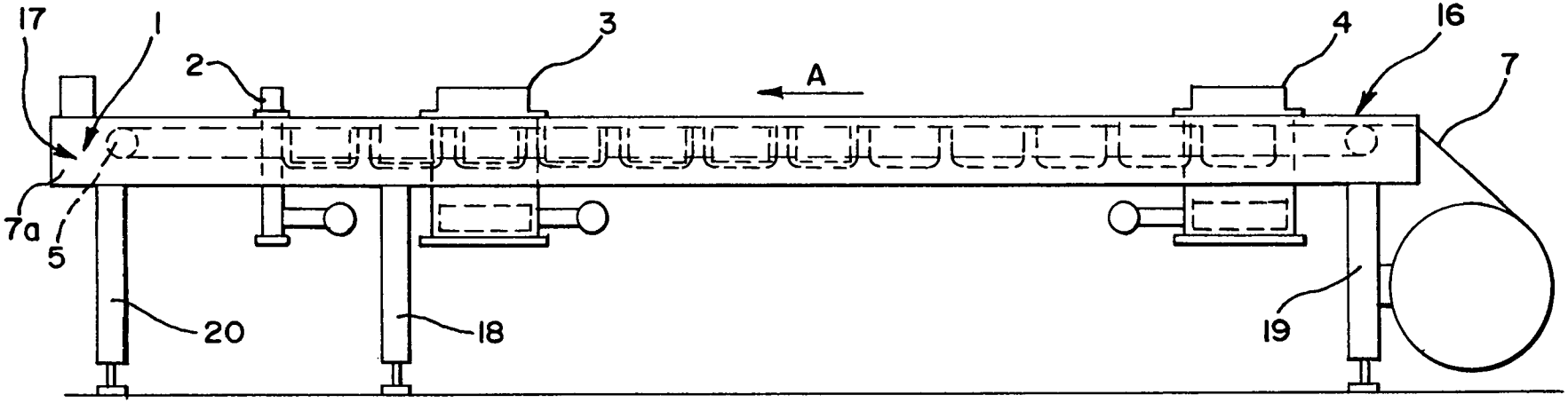
FIG. 1 is a side view of a first embodiment example of a packaging machine according to the invention.

Referring to FIG. 1, a packaging machine according to a first embodiment example has a frame 1, containing two frame parts arranged parallel to one another in the longitudinal direction, only frame part 1*a* being seen in FIG. 1. The packaging machine transports a length of packaging material 7 from an inlet 16 on an entrance side to an outlet 17 on an exit side in transport direction A. The frame parts are carried by pairs of supporting legs 18, 19 and 20. Along frame parts 1*a* are arranged working stations 2, 3 and 4, at which the length of packaging material is processed. Transport of the length of packaging material 7 takes place via transport chains 5 and 6 in the form of continuous chains.

Figure 2:
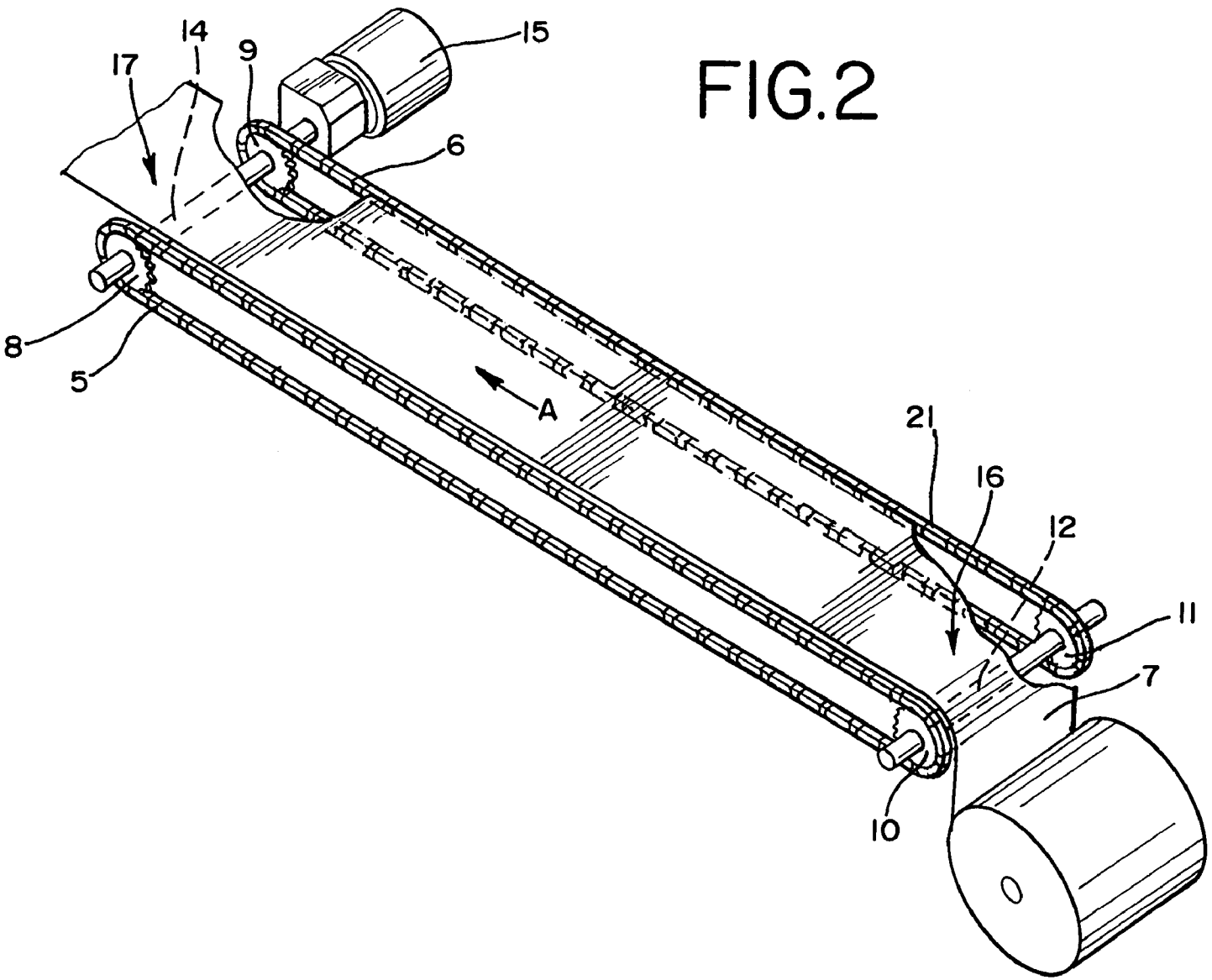
FIG. 2 is a perspective view of the first embodiment example of a packaging machine according to the invention.
Figure 3:
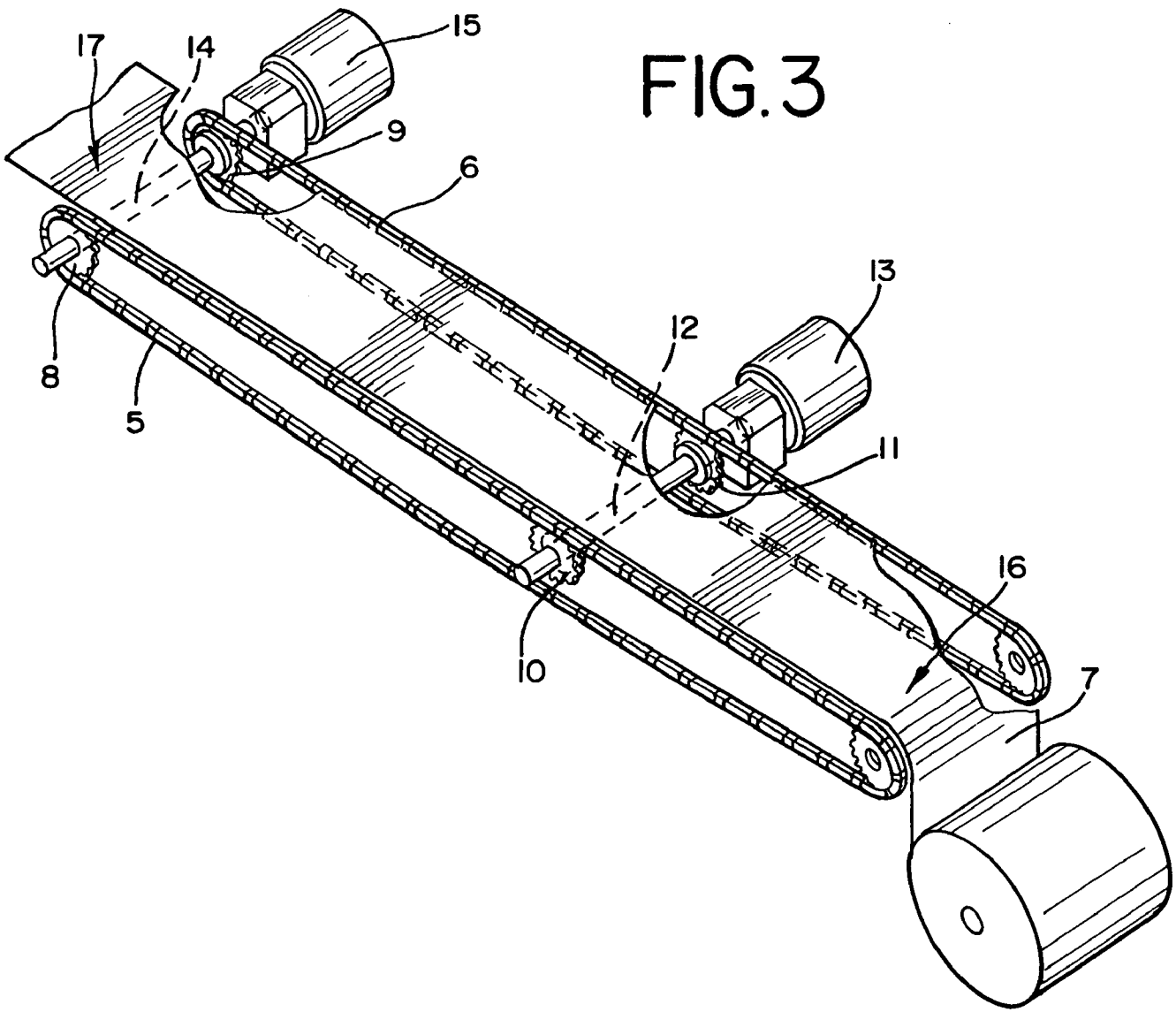
FIG. 3 is a perspective view of a second embodiment example of a packaging machine according to the invention.
Figure 4:
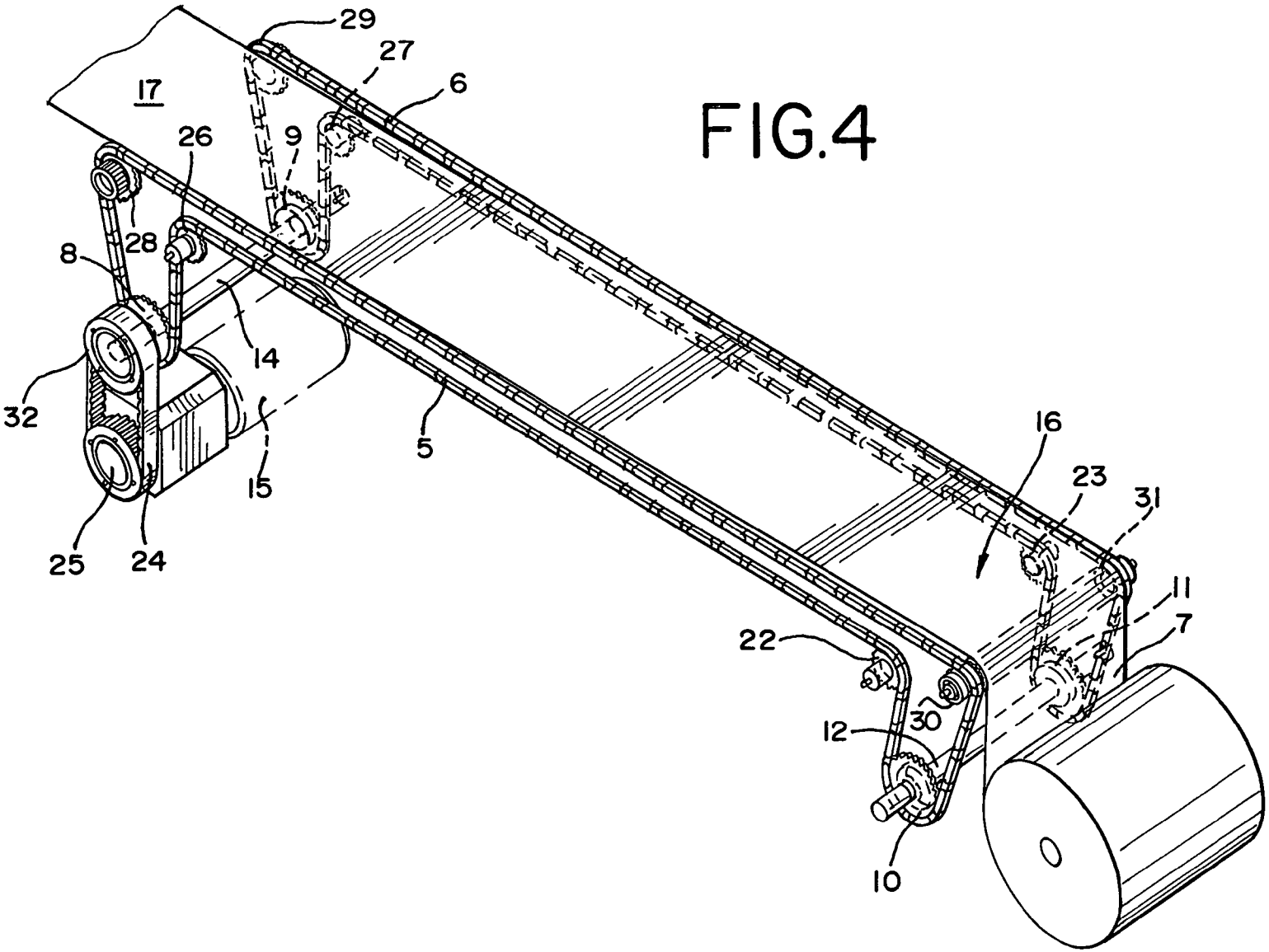
FIG. 4 is a perspective view of a third embodiment example of a packaging machine according to the invention.
Figure 5:
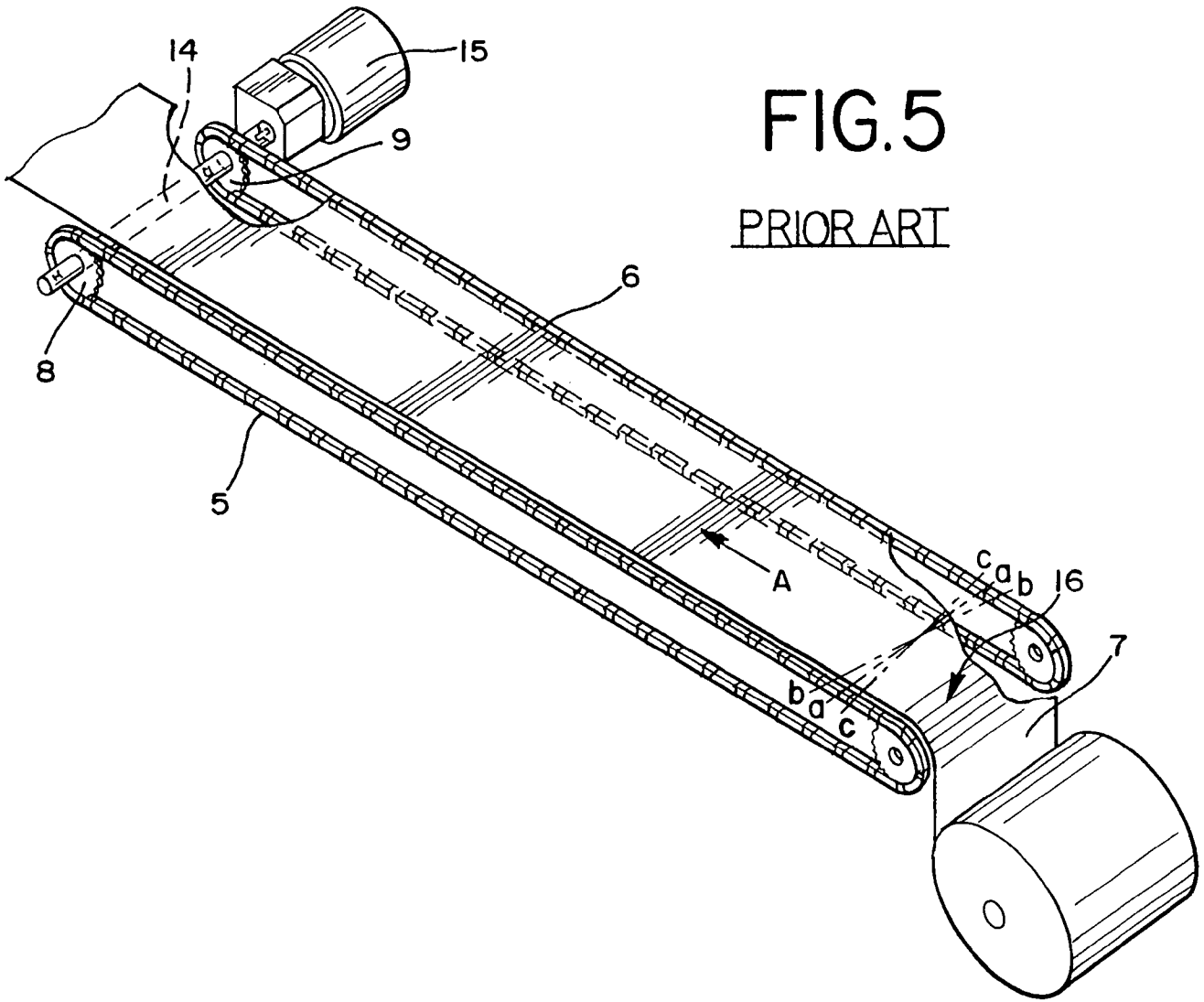
FIG.5 PRIOR ART
FIG. 5 is a perspective view of a conventional packaging machine.

In FIG. 2 and all further FIGS. 3 to 5, to simplify legibility of the figures, illustration of the frame parts has been dispensed with. According to FIG. 2 a first chain wheel 8 is allocated to the first frame part at the outlet 17 and a first engagement element 10, also constructed as a chain wheel, at the inlet 16. Correspondingly a second chain wheel 9 is allocated to the second frame part at the outlet 17 and a second engagement element 11, also constructed as a chain wheel, at the inlet 16. The two transport chains 5 and 6 run in each case via the two chain wheels 8, 9 at the outlet and via the two engagement elements 10, 11 at the inlet 16.

Each transport chain 5, 6 consists of a multiplicity of chain links, only a few of which are schematically illustrated in FIG. 2 under the reference numeral 21. The individual chain links 21 are equipped with clamps, not illustrated here, which hold the length of packaging material 7, e.g. a synthetic material foil, at its longitudinal edges. When the chain links 21 come into engagement with the engagement elements 10, 11 at the inlet 16, the clamps open, so the length of packaging material 7 can enter the clamps. When the chain links 21 are released from the engagement elements 10, 11 the clamps close and the length of packaging material is held in tensioned state between the transport chains. In reverse the clamps open at chain wheels 8 and 9 at the outlet 17. In this way the length of packaging material 7 is released from the clamps again and can leave the packaging machine via the outlet 17, while the transport chains 5, 6 are turned through 180° via the chain wheels and run back again.

The chain wheels 8, 9 are supported as fixed against rotation on a common drive shaft 14. The drive shaft 14 is coupled to a drive device 15 in the form of an electric motor. The shaft is dimensioned in such a way that it is as torsion-proof as possible, i.e. the drive shaft is as far as possible not twisted when the transport chains 5, 6 are driven, in order to prevent transport chain 5, arranged further away from the drive device 14 and driven via chain wheel 8, running behind transport chain 6, which is arranged closer to the drive device 14 and driven via chain wheel 9. The drive device 14 rotates the chain wheels 8, 9 anti-clockwise in FIG. 2, so the length of packaging material 7 is transported in transport direction A.

However, as the transport chains have limited stability, when loaded they are elastically stretched like a spring, this occurring in particular with longer plants of more than 10 m in transport length. To prevent this, the engagement elements 10, 11 provided at the inlet 16 in the form of further chain wheels are connected as fixed against rotation to one another via a torsion-proof shaft 12, so the two engagement elements 10 and 11 are forced to run synchronously to one another.

In operation the rotation-proof connection between the engagement elements 10, 11 leads to the chain links of one transport chain being forced to run at a synchronous angle to the chain links of the second transport chain.

In FIG. 3 an alternative embodiment example is shown. Construction of the packaging machine shown there is in principle identical to that of the packaging machine shown in FIGS. 1 and 2, so description of identical parts is dispensed with, as reference can be made to the preceding description.

This alternative embodiment example differs from the structure seen in FIG. 1 in that, as in conventional packaging machines, chain wheels supported freely on axles (not illustrated) are provided at the inlet. However, additionally provided between the inlet and the outlet is a further torsion-proof shaft 12, on which the two engagement elements 10, 11 are mounted as fixed against rotation in the form of chain wheels. Additionally, the shaft 12 is coupled to a further drive device 13 in the form of an electric motor. The two drive devices 13 and 15 are therein synchronized via a control unit, not illustrated, so they rotate at the same number of revolutions with synchronous angles. The packaging machine can therefore be configured as longer, the driven shaft 12 being arranged at a distance of approximately 10 meters from the first driven shaft 14, as the tolerance of the transport paths of the two transport chains, as already initially mentioned, would become impermissibly large above approximately 10 meters owing to their elastic stretching because of increased loading.

In FIG. 4 a further alternative embodiment example is shown. Construction of the packaging machine shown there is in principle identical to that of the packaging machine shown in FIGS. 1 and 2, so description of the identical components is dispensed with, as reference can be made to the preceding description.

This second alternative embodiment example differs from the structure seen in FIG. 1 in that, as with conventional packaging machines, chain wheels 30, 31 freely supported on axles (not illustrated) are provided at the inlet 16. However, additionally provided at the level of the inlet below the chain wheels 30, 31 is the torsion-proof shaft 12, on which the two engagement elements 10, 11 are mounted as fixed against rotation. For this purpose the transport chains 5, 6 are turned by approximately 90° from the horizontal downwards into the vertical in FIG. 4 via deflection rollers 22, 23 on the return side arranged below the length of packaging material 7 and run via the engagement elements 10, 11, wherein they are again turned through about 180° upwards, so they approach the length of packaging material 7 again, and are finally turned again by approximately 90° into the horizontal via the chain wheels 30, 31.

In the same way the torsion-proof shaft 14 at the outlet 17 is arranged as offset downwards, wherein the transport chains 5, 6 are correspondingly turned via chain wheels 28, 29 and deflection rollers 26, 27. Additionally, the drive device 15 is, by contrast with the first embodiment example, not directly coupled to the shaft 14. Instead, mounted on the shaft 14 as fixed against rotation is a further toothed wheel 32, which is in engagement with a toothed belt 24. The toothed belt 24 is, moreover, in engagement with a drive pinion 25, which is coupled to drive device 15 via a drive shaft, not shown. The drive device is arranged in such a way that it is located directly below the shaft 14. In this way the drive device can be accommodated in a space-saving manner inside the frame 1 and does not project laterally outwards in the width direction.

The same arrangement is also possible for drive device 13 of shaft 12.

Moreover, according to a modification, not illustrated, it is possible to drive each of chain wheels 8 to 11 via its own drive device and to match each drive device as angle-synchronous via a control unit.

A further advantageous configuration of the invention provides the use of a toothed belt instead of the transport chain.

Thus, while the invention has been described with respect to certain presently preferred embodiments, those with skill in the art will recognize changes, modifications and other applications which will fall within the scope of the inventive concepts and claims.

What is claimed is:

1. A packaging machine comprising:

a frame with two lateral frame parts opposite one another, the frame including a transport device for grasping and transporting a length of material from an entrance side to an exit side, and first and second drive motors for moving the transport device, the transport device having a first and a second transport means running from the entrance side to the exit side; a first engagement element adjacent the entrance side of the transport device engaging the first transport means; a second engagement element adjacent the entrance side of the transport device engaging the second transport means with the first engagement element coupled to the second engagement element in such a way that the two engagement elements are synchronized, and the first drive motor is arranged on the exit side of the transport device and the second drive motor directly and jointly driving the first and second engagement elements through a shaft synchronously.

2. The packaging machine according to claim 1, wherein the first and the second engagement elements are connected to one another and fixed against relative rotation via a torsion-proof shaft.

3. The packaging machine according to claims 1 or 2, further comprising a control device to control the second drive motor in such a way that it is synchronized with the first motor.

4. The packaging machine according to claim 1 wherein the each of the first and second transport means is a continuous chain and the engagement elements are each a toothed wheel for engaging the continuous chain.

5. The packaging machine according to claim 1, wherein the first drive motor of the transport device drives a first drive element for the first transport means and a second drive element for the second transport means through a shaft on which the drive elements are fixedly mounted, wherein the first and second drive elements are arranged on the exit side of the transport device.

6. The packaging machine according to claim 1, further comprising at least two pairs of synchronized engagement elements positioned along a transport path.

7. The packaging machine according to the claim 6, further comprising a control device which controls the second drive motor in such a way that it is synchronized with the first drive motor.

8. The packaging machine according to claim 7 wherein each pair of engagement elements has its own engagement element drive motor device.

9. A packaging machine, comprising:

a frame defining a transport path; a transport device comprising a first transport member formed in a continuous loop and a second transport member formed in a continuous loop, said first and second transport members spaced apart along said transport path; a first engagement clement engaging said first transport member adjacent the entrance side of die transport device and a second engagement element engaging said second transport member adjacent the entrance side of the transport device; a coupling member coupling said first and second engagement members together in synchronous movement; and a first drive motor operatively communicating with said transport members, and the first drive motor being arranged on the exit side of the transport device; and one of a) a second drive motor directly and jointly driving the first and second engagement elements through a shaft synchronously and b) a pair of second drive motors respectively connected to a shaft for driving each of the first and the second engagement elements, wherein the pair of second drive motors respectively directly drive the first and the second engagement elements synchronously.

10. The packaging machine of claim 9 further including at least one mechanism carried by each of said first and second transport members adapted to hold an elongated article for transport along said path.

11. The packaging machine of claim 10 wherein said first and second engagement elements are rotary devices and said coupling member is a shaft to which said first and second engagement elements are fixedly attached to rotate together.

12. The packaging machine of claim 11 wherein there are at least two pairs of first and second engagement elements, with said pairs spaced apart along said path, each of said pairs communicating with a second drive motor.

13. The packaging machine of claim 12 wherein each of said pairs has its own second drive motor, and further including a controller which synchronizes said second drive motor and said first drive motor for movement of said transport members along said path.

14. A method of transporting material from an entrance side to an exit side of a transport device of a packaging machine, comprising:

providing the transport device with a first transport means and a second transport means;

providing the entrance side of the transport device with a first engaging element and a second engaging element;

engaging the first transport means with the first engaging element;

engaging the second transport means with the second engaging element;

moving the transport device with a first drive motor arranged on the exit side of the transport device; and moving the first and second engaging elements with one of a) a second drive motor directly and jointly driving the first and second engaging elements trough a shaft synchronously and b) a pair of second drive motors respectively connected to a shaft for each of the first and the second engaging elements, wherein the pair of second drive motors respectively directly drive the first and the second engaging elements synchronously; thereby maintaining synchrony of the first engaging element with the second engaging element and thereby maintaining synchrony of the first transport means with the second transport means.

15. The method of claim 14, wherein said maintaining operation is performed by coupling the first engaging element to the second engaging element with a torsion-proof shaft.

16. The packaging machine according to claim 1 wherein the second drive motor is a pair of drive motors respectively connected to a shaft for each of the first and the second engagement elements, wherein the pair of drive motors respectively directly drive the first and the second engagement elements synchronously.

17. The packaging machine according to claim 1 wherein the first and second engagement elements are positioned adjacent to and spaced from the inlet side.

* * * * *